United States Patent [19]

Ueno et al.

[11] 3,976,425

[45] Aug. 24, 1976

[54] PRINTING PROCESS FOR ACRYLIC FIBERS

[75] Inventors: Eichiro Ueno, Wakayama; Hideo Kawasaki, Moriyama; Syozo Shigita, Hirakata, all of Japan

[73] Assignee: American Cyanamid Company, Stamford, Conn.

[22] Filed: Dec. 13, 1973

[21] Appl. No.: 424,409

[52] U.S. Cl. ..... 8/62; 8/177 R

[51] Int. Cl.[2] ..... D06P 1/30

[58] Field of Search ..... 8/177 R, 62

[56] References Cited

UNITED STATES PATENTS

| | | | |
|---|---|---|---|
| 3,265,461 | 8/1966 | Luetzel et al. | 8/177 R |
| 3,391,134 | 7/1968 | Kuhne et al. | 8/177 R |

*Primary Examiner*—M. J. Welsh

*Attorney, Agent, or Firm*—William J. van Loo

[57] ABSTRACT

A process for printing acrylic fiber substantially free of acid dye sites with a printing paste containing a monosulfonic acid dye having an inorganicity/organicity ratio of less than about 4 and thereafter steaming the printed fiber to fix the dye is disclosed.

6 Claims, No Drawings

PRINTING PROCESS FOR ACRYLIC FIBERS

This invention relates to a process for printing acrylic fibers. More particularly, this invention relates to such a process wherein an acrylic fiber substantially free of dye sites for acid dyes is dyed by printing said fiber with a printing paste containing a special class of acid dyes.

Acid dyes generally provide sharp colors as seen in dyed articles of nylon and this dye class has excellent physical properties, e.g. fastness to sublimation, etc. In order to dye acrylic fibers with such dyes, it is necessary to modify the fiber-forming polymer by introducing dye sites therein so that dyeing will occur by chemical action of the acid dye and the dye sites. It is generally preferred not to provide such acid dye sites since this represents difficulties in polymer preparation and can lead to fiber of poor physical properties.

Most of the commercially available acrylic fiber is substantially free of sites for acid dyes and contains only sites for basic dyes, such sites being acid groups. These fibers are generally dyed with cationic, or basic dyes. Attempts have been made to dye such fibers with acid dyes, but such attempts are directed to immersion dyeing making use of complicated dyeing auxiliaries. No attention has been directed to printing processes which require special techniques.

In accordance with the present invention, there is provided a process for dyeing acrylic fiber substantially free of acid dye sites which comprises printing said fiber with a printing paste having a pH in the range of about 5 to 10 and containing a monosulfonic acid dye which has an inorganicity/organicity ratio less than about 4 and thereafter steaming the printed fiber to fix the dye thereon. In a preferred embodiment, the printing paste also contains 1 to 10 weight percent of a solvent for the acrylic fiber.

The pH of the printing paste is above the value of 3 to 4, which is the range normally employed in immersion dyeing. Although the present inventors do not know the particular mechanism by which the special class of acid dyes are effective in dyeing acrylic fiber substantially free of sites for acid dyes and do not wish to be bound by any theoretical explanation, it is their opinion that the dyes are dispersed in the fibers in the manner of disperse dyes and are not held by ionic bonds.

In carrying out the present process, it is important that the pH of the printing paste be in the range of 5–10, preferably 6–9. If the pH is below the range stated, adsorption of the acid dye will decrease and, in extreme cases, an undesirable change in dye shade may occur. If the pH is above the range state, problems such as the decomposition of dye, discoloration of the fiber, and the like can occur.

As acrylic fibers useful in the present invention are those that are substantially free of acid dye sites, i.e. contain no basic groups. The useful fibers will contain at least about 40 weight percent acrylonitrile and will contain sites for basic dyes. Such sites include sulfonic acid groups, carboxylic acid groups, and the like. Specific examples of useful acrylic fibers include those commercially available under such trademarks as Orlon, Dynel, Creslan, Acrilan, and the like. Thus, fibers classed as acrylic and modacrylic fibers are useful.

The fibers, which may contain other fiber types in blend, are subjected to the printing operation in the form of loose fibers, slivers, yarns, woven or knit fabrics, carpets, non-woven fabrics, and the like. In particular, flat fiber products are preferred.

The dyes useful in preparing the printing paste must contain a single sulfonic acid group of the formula $-SO_3X$, wherein X is hydrogen or a monovalent cation. In addition, the dye must have an inorganicity/organicity ratio less than 4 as determined by the method described in "The Kagaku-no-Ryoiki", Vol. 11, No. 10, pages 719–725, (1957). If the dye does not possess those characteristics it is not possible to dye the stated acrylic fibers in a sufficient depth of color.

Calculation of the inorganicity/organicity ratio is illustrated in the following, using C.I. Acid Orange 7 as an example:

C.I. Acid Orange 7 =

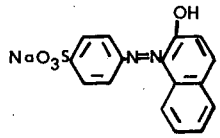

Organicity = Number of carbon atoms multiplied by 20
= 20 × 16 = 320

| | |
|---|---|
| Inorganicity = $SO_3Na$ = 250 + 500 | = 750 |
| Hydroxyl group | = 100 |
| Naphthalene nucleus | = 60 |
| —N=N— linkage | = 30 |
| Benzene nucleus | = 10 |
| TOTAL | 950 |

Inorganicity/organicity ratio = 950/320 = 2.97

As the paste forming substance used to prepare the printing paste, any of the well known conventional materials may be used such as starch, sodium alginate, processed starches, modified celluloses such as carboxymethyl cellulose, crystal gum, locust bean gum or modified product thereof, or an emulsion paste wherein an emulsifying agent is present in the paste solution. The printing paste will be conventional except with respect to the specific acid dye contained therein.

In particular, when about 1 to 10 weight percent of a solvent for the acrylic fiber is present in the printing paste, the adsorption of dye by the fiber can be increased. Suitable solvents include ethylene carbonate, dimethyl formamide, aqueous solution of thiocyanate salts, and the like. If less than 1 percent of fiber solvent is used, no improvement in dye absorbence is noted. When more than 10 weight percent of fiber solvent is employed, the dangers of fiber dissolution or weakening can ensue.

After the fiber product has been printed with the print paste in accordance with conventional procedures, it is subjected to steaming to fix the dye on the fiber. Desirably, the heat treatment is carried out at a temperature in excess of 100°C., preferably in excess of 110°C., for at least about five minutes. Low temperatures are ineffective in that the amount of dye adsorbed by the fiber is too low. After steaming, the printed fiber product is subjected to washing, rinsing, and drying in accordance with conventional procedures.

The invention is more fully illustrated by the examples which follow wherein all parts and percentages are by weight unless otherwise specifically designated.

EXAMPLE 1

A knit fabric produced from spun acrylic fiber yarn sold under the trademark Exlan DK and containing no basic groups was printed using an automatic screen printing machine. The printing paste had a pH of 8.7 and consisted of 2 parts of C.I. Acid Yellow 49, a dye having a single sulfonic acid group and an inorganicity/organicity ratio of 2.8, 2 parts of thiodiethylene glycol, 60 parts of an 11% aqueous solution of Indalca ABV as paste-forming material, 4 parts of ethylene carbonate, and 32 parts of water. After printing, the fabric was steamed at 110°C. for 30 minutes. Thereafter, the printed fabric was washed, rinsed, and dried by conventional procedure. The fabric obtained showed sharp and level patterns and had good color fastness and resistance to crocking.

COMPARATIVE EXAMPLE A

The procedure of Example 1 was repeated in every material detail except for the dye used therein, there was substituted an equal amount of a dye of the following structure:

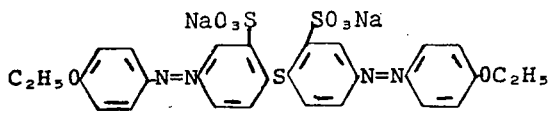

The dye used had two sulfonic acid groups and an inorganicity/organicity ratio of 2.8 and was therefore not of the present invention. The fabric obtained was substantially undyed.

EXAMPLE 2

A woven fabric produced from spun acrylic fiber yarn containing only sulfonic acid groups as dye sites was printed as in Example 1. The printing paste had a pH of 9.5 and consisted of 2 parts of a monosulfonic acid dye having an inorganicity/organicity ratio of 2.5 and the following structure:

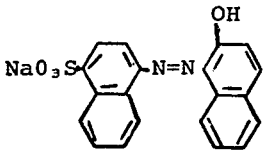

2 parts of thiodiethylene glycol, 60 parts of Sorbitose C-5 as paste-forming material, and 36 parts of water. The printed fabric was then steamed at 120°C. for 20 minutes, after which it was washed, rinsed, and dried. The printed fabric showed a fine red pattern which was color fast and resistant to crocking.

EXAMPLE 3

The procedure of Example 2 was repeated in every material detail except that for the dye therein there was substituted an equal amount of C.I. acid Red 257, which contains a single sulfonic acid group and an inorganicity/organicity ratio of 2.4. A printed fabric of comparable properties to that of Example 2 was obtained.

COMPARATIVE EXAMPLE B

Following the procedure of Example 2 in every material detail except for the dye employed, a printing was made using a dye of the following structure:

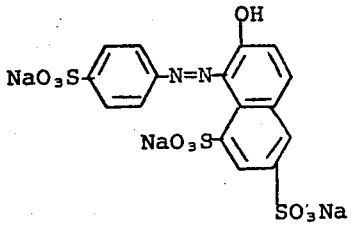

The dye has three sulfonic acid groups and an inorganicity/organicity ratio of 6.3, therefor it is not the present invention. The acrylic fabric remained substantially undyed as a result of printing.

EXAMPLE 4

A single knit fabric produced from spun acrylic yarn containing no basic groups was printed as before using a printing paste of pH 6.2 consisting of one part of a monosulfonic acid dye of the structure

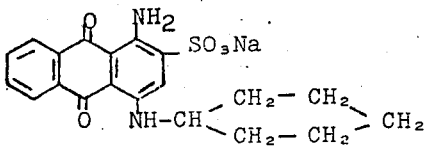

one part of thiodiethyleneglycol, 60 parts of a 10% aqueous solution of carboxymethyl-cellulose, 4 parts of ethylene carbonate, and 34 parts of water. The printed fabric was steamed at 115°C. for 20 minutes and then washed, rinsed, and dried. An excellent dyeing with desirable fabric feel was obtained.

EXAMPLES 5–11

Following the procedure of Example 1, a series of printings were made substituting the dyes listed below for that of Example 1. In each instance an excellent dyeing was obtained. The dye structure, color and inorganicity/organicity ratio, I/O, for each example is listed below in Table I.

TABLE I

| EXAMPLE | DYE STRUCTURE | I/O | COLOR |
|---|---|---|---|
| 5 | 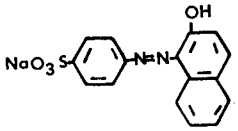 | 3.0 | Reddish Orange |

TABLE I-continued

| EXAMPLE | DYE STRUCTURE | I/O | COLOR |
|---|---|---|---|
| 6 | 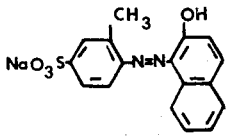 | 2.8 | Reddish Orange |
| 7 | 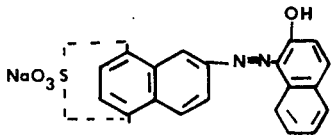 | 2.5 | Yellowish Red |
| 8 | 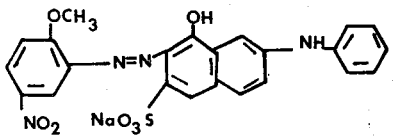 | 2.1 | Brown |
| 9 | 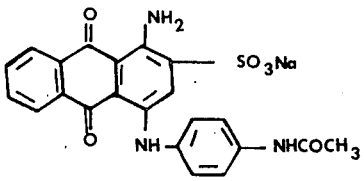 | 3.0 | Greenish Blue |
| 10 | 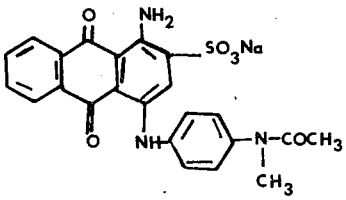 | 3.2 | Blue |
| 11 | 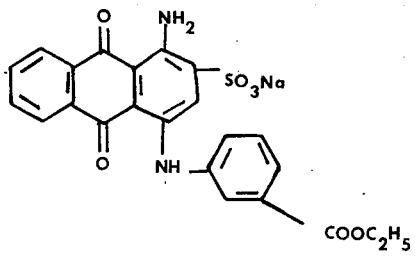 | 2.8 | Blue |

We claim:

1. A process for dyeing acrylic fiber and modacrylic fiber of at least about 40 weight percent acrylonitrile and substantially free of acid dye sites which comprises printing said fiber with a printing paste having a pH in the range of about 5 to 10 and containing a monosulfonic acid dye which has an inorganicity/organicity ratio less than about 4 and thereafter steaming the printed fiber to fix the dye thereon.

2. The process of claim 1 wherein an acrylic fiber solvent is present in said printing paste in the amount of 1 to 10 weight percent based on the total weight of paste.

3. The process of claim 1 wherein the pH is in the range of 6–9.

4. The process of claim 2 wherein the acrylic fiber solvent is ethylene carbonate.

5. The process of claim 1 wherein steaming is at a temperature of above 100°C. for at least 5 minutes.

6. The process of claim 5 wherein the temperature is above 110°C.

* * * * *